US006344017B1

(12) United States Patent
Teeter

(10) Patent No.: US 6,344,017 B1
(45) Date of Patent: Feb. 5, 2002

(54) LOCKING STRUCTURE OF PIVOT ARM OF INVERTING MACHINE

(76) Inventor: Roger C. Teeter, 20720 Snag Island Dr., Sumner, WA (US) 98390

( * ) Notice: Subject to any disclaimer, the term of this patent is extended or adjusted under 35 U.S.C. 154(b) by 0 days.

(21) Appl. No.: 09/495,325

(22) Filed: Feb. 1, 2000

(51) Int. Cl.[7] ..... A63B 26/00
(52) U.S. Cl. ..... 482/144; 5/610
(58) Field of Search ..... 5/81.1 RP, 610; 482/144, 907

(56) References Cited

U.S. PATENT DOCUMENTS 5,551,937 A * 9/1996 Kwo ..... 482/144
5,967,956 A * 10/1999 Teeter ..... 482/144

* cited by examiner

*Primary Examiner*—Janice L. Krizek
(74) *Attorney, Agent, or Firm*—Browdy and Neimark

(57) ABSTRACT

A locking structure of pivot arms of an inverting machine comprises a leg frames two pivot arms, and an inverting platform The leg frame has two pivoting ends which arc provided with a slot. The two pivot arms are provided with a plurality of locating through holes and at one end thereof with a pivoting pillar which is pivoted in the slot of the leg frame. The inverting platform is provided in two sides thereof with a receiving member which has a retaining slot for retaining the pivot arm. The retaining slot is provided in the bottom wall thereof with a locating pillar engageable with any one of the locating through holes of the pivot arm. The receiving member is provided with a locking member for locking the pivot arm in the receiving member.

4 Claims, 4 Drawing Sheets

LOCKING STRUCTURE OF PIVOT ARM OF INVERTING MACHINE

FIELD OF THE INVENTION

The present invention relates generally to an inverting machine, and more particularly to a locking structure of pivot arm of the inverting machine.

BACKGROUND OF THE INVENTION

As shown in FIGS. 1 and 2, an inverting machine of the prior art comprises an inverting platform 11 which is provided in two sides thereof with a pivot arm 12, and a leg frame 13 having two pivoting ends which arc provided with a slot 14 for pivoting a pivot pillar 15 of the pivot arm 12. Each of the two pivot arms 12 is of a long platelike construction and is provided with three through holes 16. The inverting platform 11 is provided in two sides thereof with a receiving member 17 which has a bottom wall 171 and is provided in two sides thereof with a raised side wall 172. These two side walls 172 are provided inwardly and oppositely with a stop portion 173 which is separated from the bottom wall 171 by a distance slightly greater than the thickness of the pivot arm 12. The receiving member 17 is provided with an insertion slot 174. The receiving member also has a locating pillar 175. The pivot arm 12 is inserted into the insertion slot 174 of the receiving member 17 such that one of the three through holes 16 of the pivot arm 12 is engaged with the locating pillar 175.

In view of the pivot arm 12 being retained only by the receiving member 17, there is a considerably large gap between them. As a results there is always a noise caused by the collision of metals at such time when the inverting machine of the prior art is in use. In addition, the inverting machine in operation is susceptible to a slight sway, thereby causing its user to have an insecure feeling. Moreover, an incorrect assembly of the prior art inverting machine can result in a serious consequence The case in point is that some absent-minded or careless users are likely to insert the entire pivot arm 12 into the insertion slot 174 of the receiving member 17 without retaining the locating pillar 175 in one of the three through holes 16.

SUMMARY OF THE INVENTION

It is the primary objective of the present invention to provide an inverting machine with a pivot arm locking structure which is structurally secure and is relatively free from noise when in operation.

It is another objective of the present invention to provide an inverting machine with a pivot arm locking structure which is foolproof.

In keeping with the principle of the present invention, the foregoing objectives of the present invention are attained by an inverting machine comprising a Icg frame, two pivot arms, and a inverting platform. The leg frame has two pivoting ends which arc provided with a slot. The two pivot arms are of a long platelike construction and are provided with a plurality of locating through holes. The pivot arms are provided at one end thereof with a pivoting pillar which is pivoted in the slot of the leg framc The inverting platform is provided in two sides thereof with a receiving member which has a retaining slot for retaining the pivot arm The retaining slot is provided in the bottom wall thereof with a locating pillar which is received in one of the through holes of the pivot arm. The present invention is characterized by the receiving member which is provided with a locking member for locating the pivot arm securely with the receiving member.

DETAILED DESCRIPTION OF THE INVENTION

Figure 1:
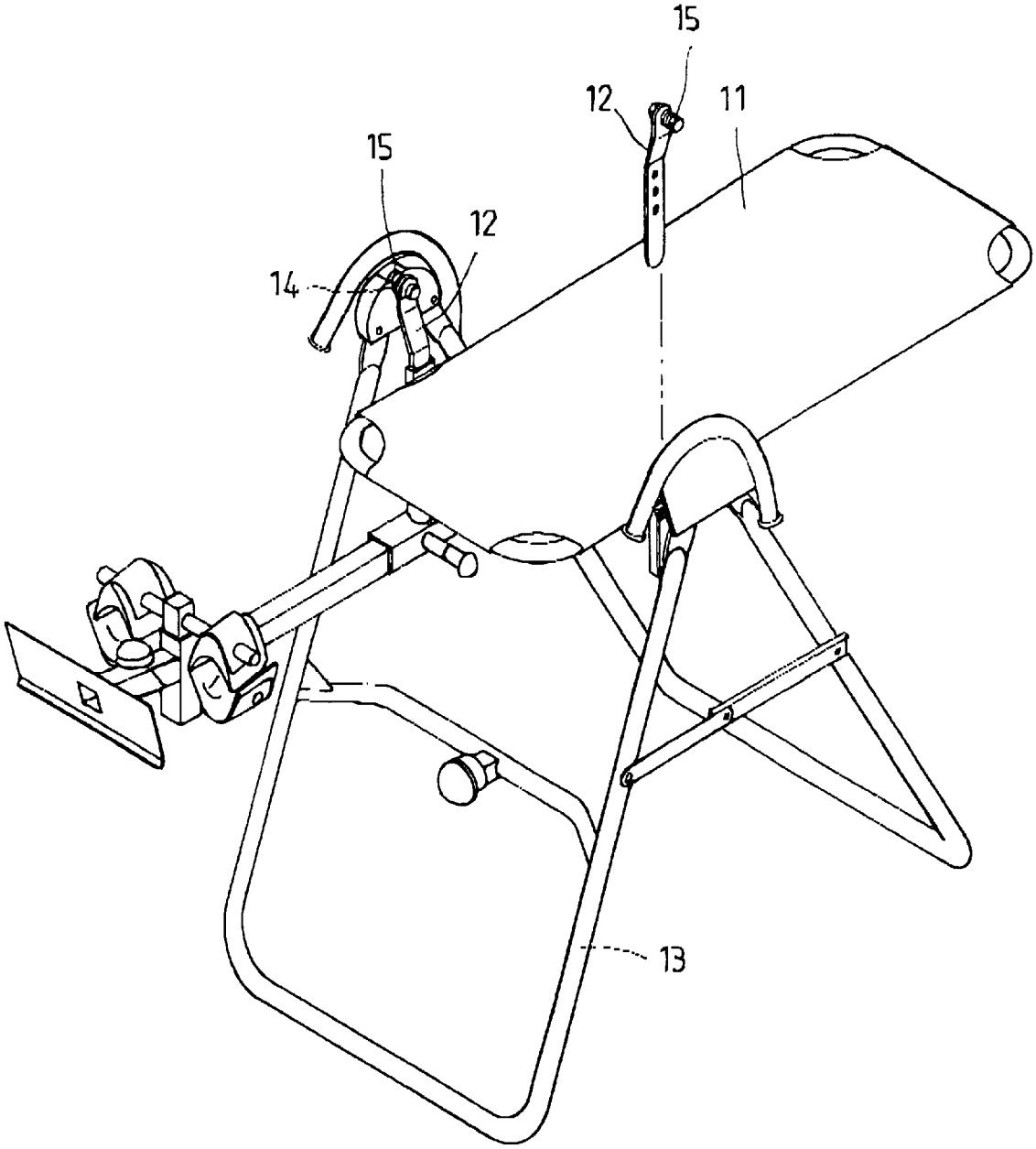
FIG.1 PRIOR ART
FIG. 1 shows a partial exploded view of an inverting machine of the prior art.
Figure 2:
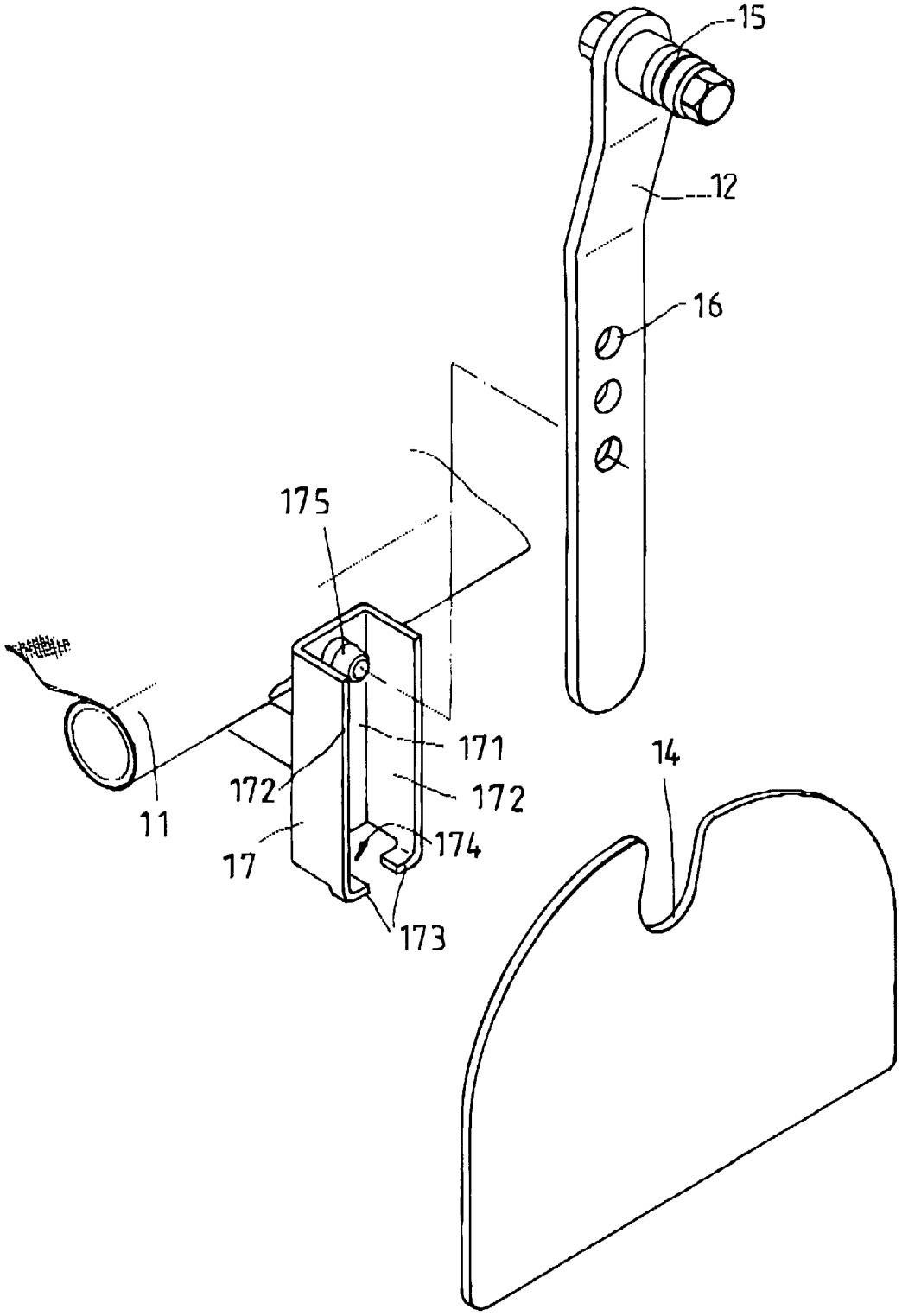
FIG. 2 PRIOR ART
FIG. 2 shows an exploded view of a pivot arm and a receiving member of the prior art inverting machine.
Figure 3:
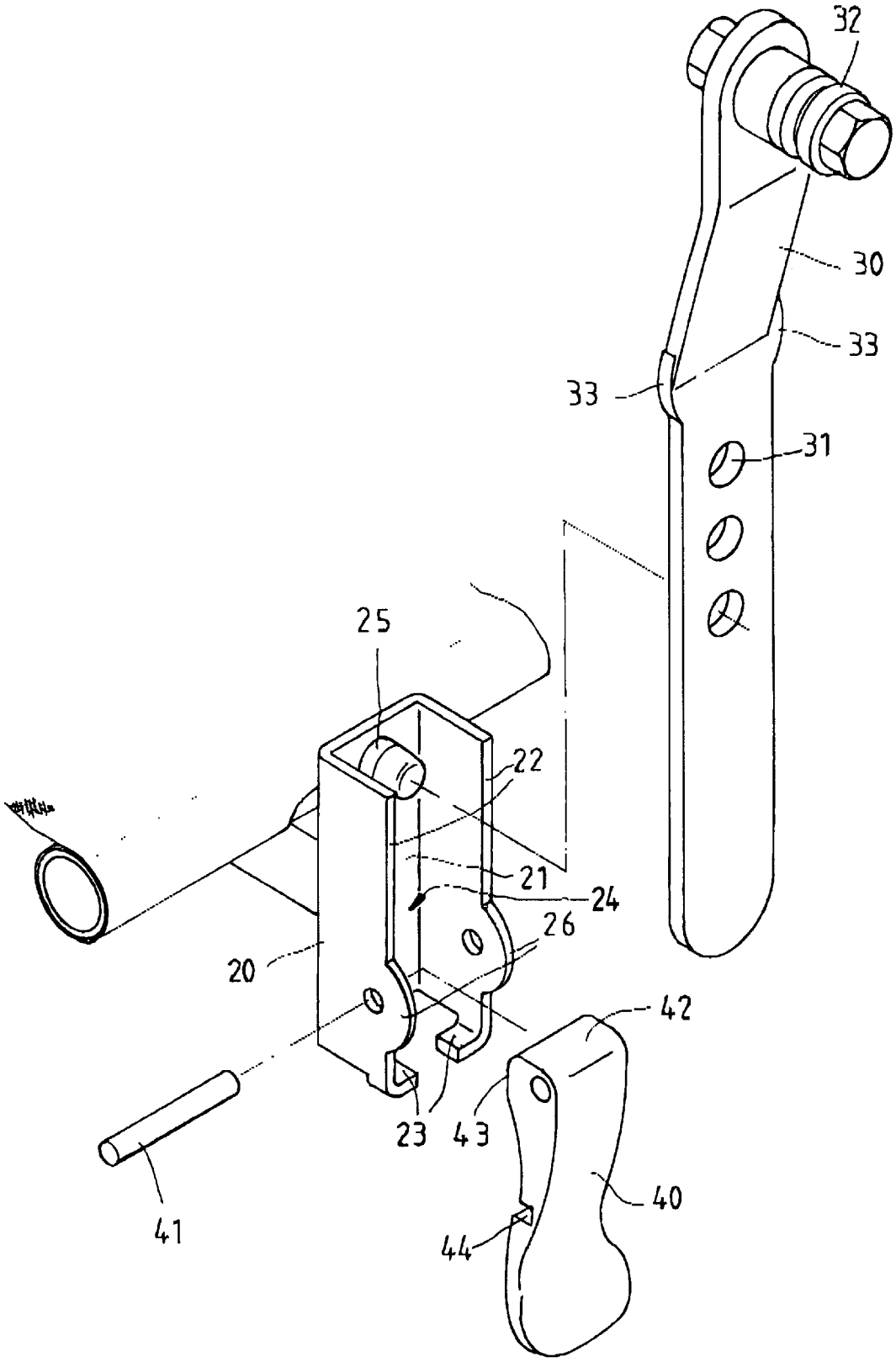
FIG. 3 shows an exploded view of a preferred embodiment of the present invention.
Figure 5:
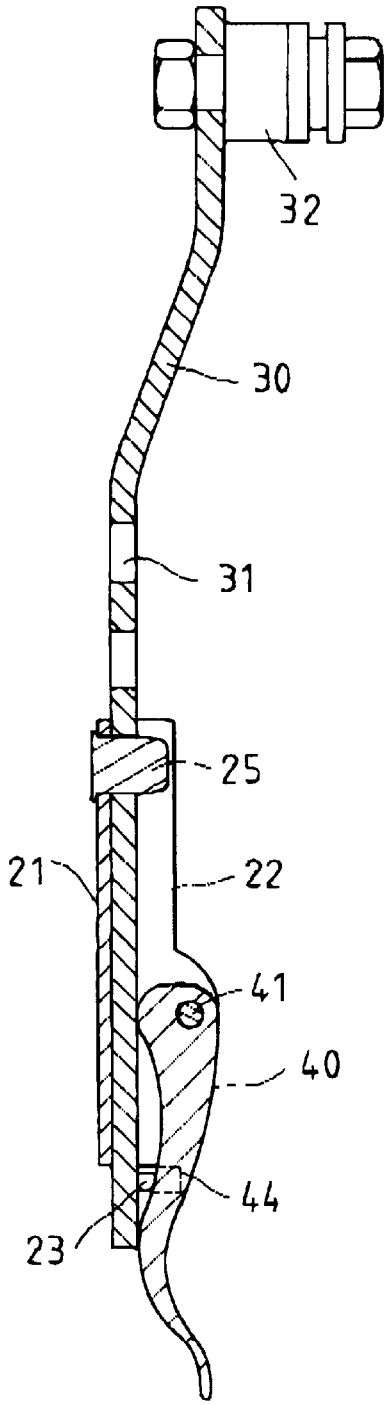
FIG. 5 shows a sectional view of a portion taken along the direction indicated by a line 5—5 as shown in FIG. 4.
Figure 4:
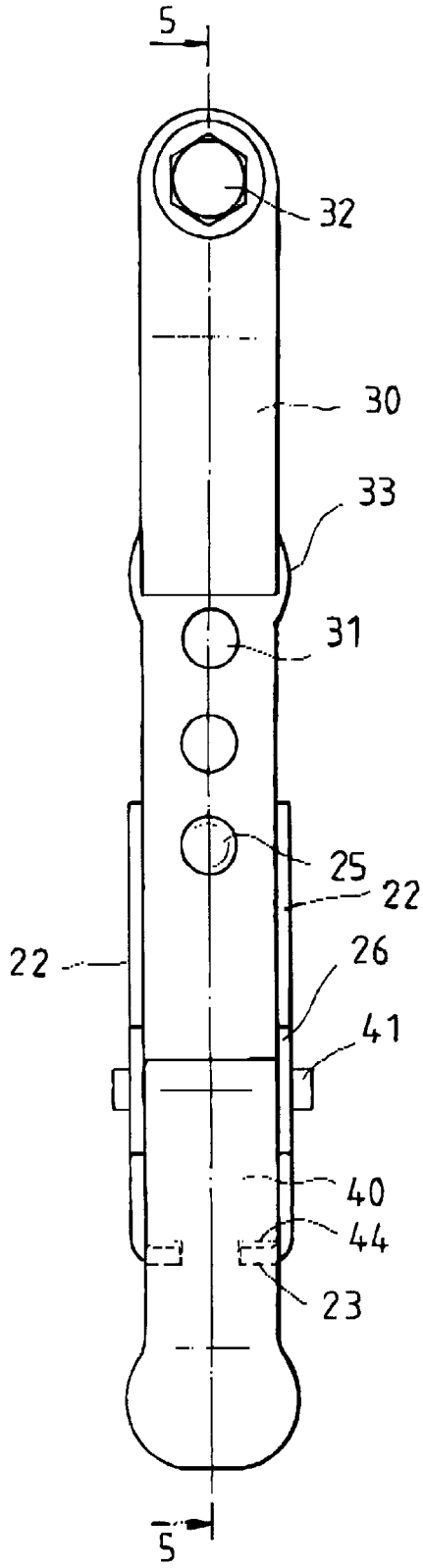
FIG. 4 shows a front view of the preferred embodiment of the present invention in combination.

As shown in FIGS. 3–5, the preferred embodiment of the present invention is intended to overcome the deficiency of the engagement of the pivot arm with the receiving member of the prior art inverting machine. The description of the present invention is therefore confined to the pivot arm locking structure of one side of an inverting machine.

The locking structure of the preferred embodiment of the present invention comprises a receiving member 20, a pivot arm 30, and a locking member 40.

The receiving member 20 has a bottom wall 21 which is provided in two sides thereof with a protruded side wall 22. These two side walls 22 arc provided inwardly and oppositely at one end thereof with a stop portion 23 which is separated from the bottom wall 21 by a distance. The receiving member 20 is provided with a retaining slot 24. The bottom wall 21 is provided at the end opposite of the stop portion 23 with a locating pillar 25. Two side walls 22 are provided with a lug 26 located between the locating pillar 25 and the stop portion 23.

The pivot arm 30 is of a long platelike construction and is provided along the longitudinal direction thereof with three or more through holes 31. The pivot arm 30 is further provided at one end thereof with a pivoting pillar 32. The pivot arm 30 is still provided with two protrusions 33 which are located at both sides contiguous to the innermost through hole 31. The two protrusions 33 are separated from each other by a distance greater than the distance between the two side walls 22 of the receiving member 20. The pivot arm 30 can be inserted into the retaining slot 24 of the receiving member 20 such that one of the through holes 31 is engaged with the locating pillar 25, as shown in FIGS. 4 and 5. The two protrusions 33 serve to prevent improper insertion of the pivot arm 30 in view of the protrusions 33 being wider than the retaining slot 24. As a result, the portion beyond the through holes 31 can not be inserted into the retaining slot 24.

The locating member 40 is fastened pivotally between the two lugs 26 of the receiving member 20 by a pivot pin 41. The locking member 40 is of a long platelike construction and is provided at a pivoting end thereof with an unlocking surface 42 and a locking surface 43 located at an angle of 90 degrees relative to the unlocking surface 42. The locking surface 43 is separated from the pivot pin 41 by a distance greater than the distance separating the unlocking surface 42 from the pivot pin 41, as shown in FIG. 5. The pivot arm 30 is forced by the locking surface 43 to remain in an intimate association with the receiving member 20. As the locking member 40 is pulled outwardly about 90 degrees such that the unlocking surface 42 faces the pivot arm 30, the pivot arm 30 can be disengaged with the receiving member 20. The locking member 40 is made of a plastic material and is provided with two slots 44 corresponding in location to the two stop portions 23 of the receiving member 20 for preventing the collision with the stop portions 23 in the locking state.

In light of the two pivot arms being locked securely by the locking member at such time when the pivot arms are in an intimate contact with the receiving member, the inverting machine can operate with stability and without noise.

What is claimed is:

1. A locking structure of pivot arms of an inventing machine, comprising:

a leg frame having two pivoting end, with each being provided with a slot;

two pivot arms each of a long platelike construction and provided with a plurality of locating through holes and at one end thereof with a pivoting pillar, a respective pivoting pillar is pivoted in said slot of said pivoting end, an inverting platform provided in two sides thereof with a receiving member having a retaining slot for retaining a respective pivot arm, said receiving member having a bottom wall with a locating pillar engageable with any one of said locating through holes of said pivot arm;

wherein said receiving member is provided with a locking member for locking said pivot arm in said receiving member.

2. The locking structure as defined in claim 1, wherein said bottom wall of said receiving member is provided in two sides thereof with a side wall which is in turn provided at one end thereof with a stop portion, said stop portion being separated from said bottom wall by a distance greater than a thickness of said pivot arm; wherein said locking member is disposed between said two side walls such that said locking member forces said pivot arm to be engaged with said bottom wall of said receiving member.

3. The locking structure as defined in claim 1, wherein said locking member is pivoted between said two side walls by a pivot pin and is of a long platelike construction, said locking member being provided at a pivoting end thereof with an unlocking surface and d locking surface contiguous and perpendicular to said unlocking surface such that said locking surface is separated from said pivot pin by a distance greater than a distance separating said unlocking surface from said pivot pin, and that said locking surface forces said pivot arm to be intimately engaged with the bottom wall of said receiving member.

4. The locking structure as defined in claim 1, wherein said pivot arms are each provided with two protrusions located in two sides contiguous to an innermost locating through hole whereby said two protrusions are separated from each other by a distance greater than a distance separating said two side walls of said receiving member.

* * * * *